US005640770A

United States Patent [19]

Fowler

[11] Patent Number: 5,640,770

[45] Date of Patent: Jun. 24, 1997

[54] ERGONOMIC NAIL CLIPPER

[75] Inventor: James F. Fowler, Snohomish, Wash.

[73] Assignee: Kenneth and Virginia Goodell

[21] Appl. No.: 595,740

[22] Filed: Feb. 2, 1996

[51] Int. Cl.[6] ..... A45D 29/02; B26B 13/26

[52] U.S. Cl. ..... 30/29; 30/243

[58] Field of Search ..... 30/26, 28, 29, 30/241, 243, 335; 132/73, 75.4, 75.5

[56] References Cited

U.S. PATENT DOCUMENTS

| | | | |
|---|---|---|---|
| 448,092 | 3/1891 | Stout | 30/243 |
| 2,837,821 | 6/1958 | David | 30/28 |
| 2,955,354 | 10/1960 | Laing | 30/29 |
| 3,838,507 | 10/1974 | Clark | 30/29 |
| 4,856,190 | 8/1989 | Reiswig | 30/29 |
| 5,065,513 | 11/1991 | Reiswig | 30/29 |
| 5,459,926 | 10/1995 | Perea | 30/28 |

*Primary Examiner*—Hwei-Siu Payer

*Attorney, Agent, or Firm*—Marger, Johnson, McCollom & Stolowitz

[57] ABSTRACT

A clipper for artificial finger nails includes a substantially planar nail holder having an arcuate opening therethrough for receiving an acrylic finger nail. Such a nail is cut by a blade in sliding face-to-face relation with the nail holder which slides over the opening thereby cutting the nail. A slot in the blade has a post extending therethrough. A screw mounted on one end of the post is received in a threaded insert formed in a nose piece. On the other end of the post, a knurled knob facilitates disassembly for changing a blade. A pair of transverse slots formed in the blade receive a pair of teeth formed on a pivotable clipper handle for converting rotational handle movement into transverse blade movement in rack-and-pinion fashion. Cut tips of the acrylic nails are caught and retained in a nail catcher mounted on the nail holder.

19 Claims, 2 Drawing Sheets

ERGONOMIC NAIL CLIPPER

BACKGROUND OF THE INVENTION

1. Field of the Invention

The present invention relates generally to fingernail clippers and more particularly to such clipper which are for trimming artificial nails attached to natural fingernails.

2. Description of the Related Art

Artificial nails, such as acrylic artificial nails, attach to a wearer's natural fingernails and are thereafter cut, filed, painted, and buffed. Artificial nails are typically longer and thicker than the wearer's natural nails. Application of a full set of artificial nails can be a time consuming process.

Prior art clippers for artificial nails are disclosed in U.S. Pat. No. 4,856,190 to Reiswig for a single cut clipper for artificial nails; U.S. Pat. No. 5,065,513 to Reiswig for an artificial fingernail clipper and U.S. Pat. No. 5,357,676 to Bannett for a nail blunt clipper. Clippers of the type shown in the prior art Reiswig patents include a substantially planar nail holder having an aperture therethrough. A substantially planar blade including a cutting edge, slides over the aperture for cutting an artificial nail inserted in the aperture. Prior art clippers suffer from a number of deficiencies. Such clippers includes a body having a first handle formed thereon and a second handle permanently attached to the body. Prior art clippers are made of metal and the handles are not particularly easy to grasp or squeeze. In the prior art clippers, the blade includes an elongate slot having a separate spacer received therein. The spacer is mounted on the nail holder with a screw which passes through a bore in the spacer and is engaged with a threaded bore in the nail holder. The spacer must be removed and replaced every time a blade is changed or sharpened. This requires a screwdriver and a fair amount of manual dexterity to properly place the spacer in the slot and screw it onto the nail holder. Also, the spacer tends to twist and bind against the sides of the slot formed in the blade making blade travel more or less difficult depending upon how much torque has been applied to the screw mounting the spacer.

The body, handles and mechanism for sliding the blade in the Reiswig '190 clipper is substantially identical to the mechanism disclosed in U.S. Pat. No. 3,838,507 to Clark for an animal nail clipper. The linkage for connecting one of the handles to the blade in the Reiswig '513 patent is also similar to that used in the Clark animal nail clipper. In both the Reiswig clippers, a portion of the blade slot is received in a notch formed in the metal handle. This contributes to difficulty in changing blades and does not provide smooth and easy blade travel responsive to squeezing the handles together.

Prior art blades are either curved or have a straight blade edge oriented substantially 90° to the direction of blade travel. This makes cutting more difficult than if the nail was cut at an angle and also results in a less smooth edge when cutting is complete.

It would be desireable to provide an artificial nail clipper which overcomes the above-enumerated disadvantages associated with prior art clippers.

SUMMARY OF THE INVENTION

In one aspect, the clipper of the present invention comprises a substantially planar nail holder having an aperture for receiving a fingernail to be clipped. A substantially planar blade including a blade edge is in slidable face-to-face relation, along a sliding axis, with one side of the nail holder. An elongate slot formed along the blade is substantially parallel to the sliding axis. A post extending through the slot has a head formed on one end of the post which is adjacent one side of the nail holder. A threaded shaft formed on the other side of the post is threadably engaged with a threaded insert. The threaded shaft is tightened until a shoulder formed at the juncture of the post and the threaded shaft abuts against the threaded insert.

In another aspect, a second slot is formed in the blade. A tooth mounted on the handle extends into the second slot and slides the blade responsive to pivoting of the second handle.

In still another aspect, a nail catcher is operably connected to the nail holder for catching a fingernail cut when the blade slides over the aperture and the fingernail is received therethrough.

In yet another aspect, a surface adjacent the apeture functions as a length gauge when a nail extending through the apeture is urged agasint the surface prior to cutting.

The above and other advantages associated with the present invention will become more readily apparent when the detailed description of the invention is read in light of the following drawings.

DETAILED DESCRIPTION OF THE PREFERRED EMBODIMENT

Figure 1:
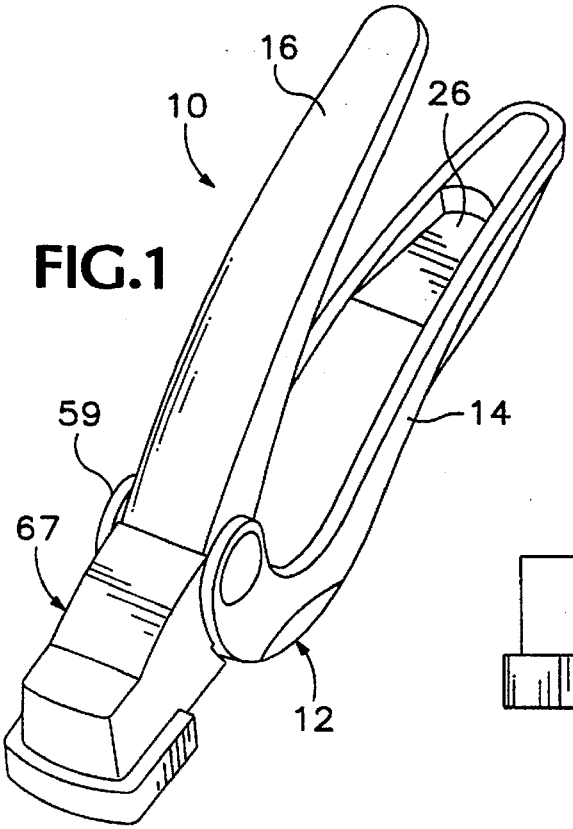
FIG. 1 is a perspective view of a clipper constructed in accordance with the present invention.
Figure 2:
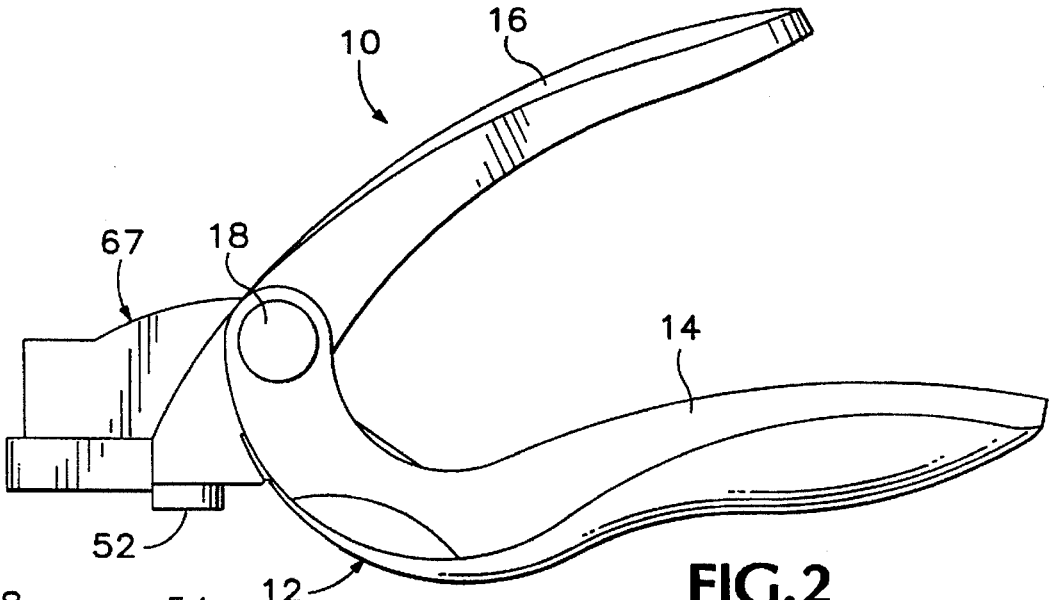
FIG. 2 is a slightly enlarged side elevation view of the clipper of FIG. 1.

Indicated generally at 10 in the drawing is a clipper constructed in accordance with the present invention. Clipper 10 includes a body 12 which incorporates a first handle 14. A second handle 16 is pivotally connected to body 12 with a plastic fastener 18. The rivet includes a rivet shaft 19, shown in section in FIGS. 6 and 7. Handle 16 pivots about the axis of rivet shaft 19 between a normally open position depicted in FIGS. 1, 2, and 6, and a compressed position depicted FIG. 7 which results when the user squeezes handles 14, 16 together.

Figures 6, 7, 8:
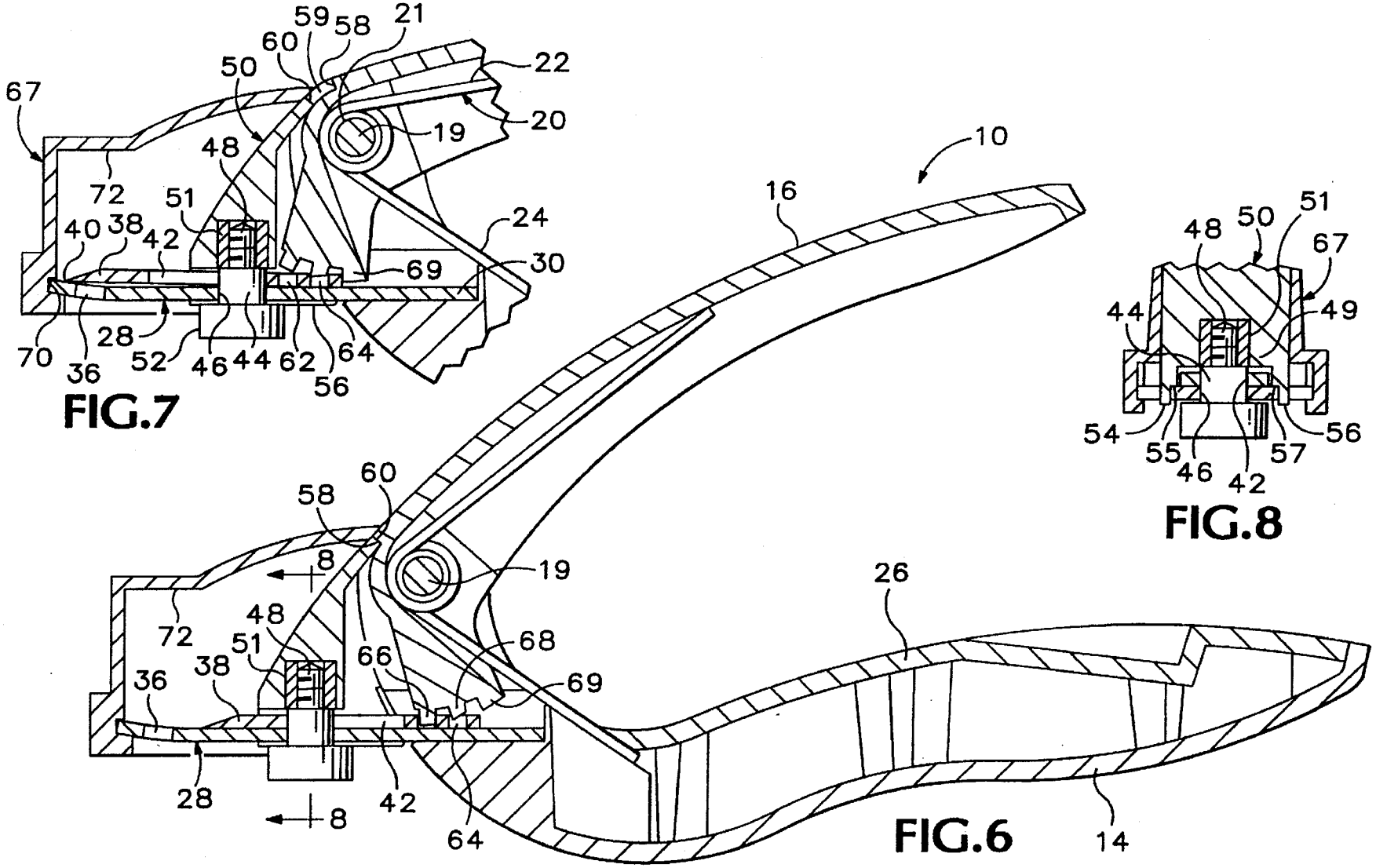
FIG. 6 is an enlarged side elevational view similar to FIG. 2 showing the clipper in section.
FIG. 7 is a partial view of a portion of the clipper of FIG. 6 showing the blade in an extended position resulting from squeezing the handles together.
FIG. 8 is a view taken along line 8—8 in FIG. 6.

A torsion spring 20 includes a coil portion 21, in FIGS. 6 and 7, and a pair of legs 22, 24 which are received into interior portions of handles 16, 14, respectively, as best seen in FIG. 6. Spring 20 biases handles 14, 16 apart into the position shown in FIGS. 1, 2, and 6. A cover 26, viewable in FIGS. 1 and 6, covers an interior cavity of handle 14 into which leg 24 of spring 20 extends. Body 12, including handle 14; handle 16; and cover 26 are each, in the present embodiment of the invention, molded utilizing a known polymer and molding process.

A substantially planar nail holder 28 includes a proximal end 30, in FIGS. 6 and 7, which is mounted on body 12 during the molding process.

A distal end 34 of nail holder 28 includes a slight upward curve, best viewed in FIGS. 6 and 7, which facilitates nail cutting as will later be described. An arcuate aperture 36 extends through nail holder 28 for receiving an acrylic nail as is discussed hereinafter in connection with the description of the use of clipper 10.

Figure 5:
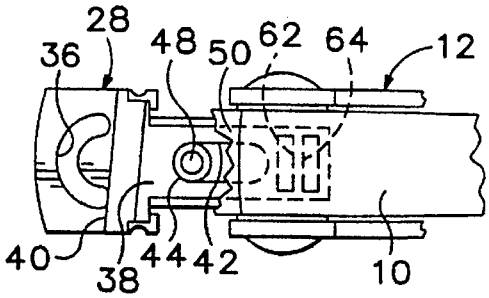
FIG. 5 is a top plan view of the clipper portion shown in FIG. 4 with the nose piece shown partially broken away.

In the present embodiment of the invention, nail holder 28 is metal. A substantially planar blade 38 is also made of metal. Blade 38 includes a cutting edge 40 which is angled as best viewed in FIG. 5. The blade travels along an axis parallel to the plane of the paper from its normally retracted position, shown in FIG. 6, to an extended position, shown in FIG. 7, responsive to squeezing handles 14, 16 together.

Consideration will now be given to structure which drives the blade between the positions depicted in FIGS. 6 and 7 as well as the structure which guides it during such driving. Blade 38 includes an elongate slot 42, best viewed in FIG. 5, having a longitudinal axis parallel to the direction of blade movement. A cylindrical post 44 is received through slot 42 and through a bore 46, in FIG. 8, formed in nail holder 28 which is just large enough to receive post 44 therethrough. Similarly, slot 42 is just wide enough to receive post 44 therethrough and includes a pair of opposed rounded ends viewable in FIG. 5. The left most end, as viewed in FIGS. 5–7, substantially abuts against a semicircular portion of post 44 in the view of FIGS. 5 and 6. The right most end of slot 42 substantially abuts against a semicircular portion of post 44 when blade 38 is in the position of FIG. 7.

A threaded shaft 48 extends from an upper end of post 44 and is threadably engaged in a brass insert 51 received in a molded nose piece 50. A shoulder 49 is formed on one end of post 44 at its juncture with threaded shaft 48. Nose piece 50 is molded from the same material as body 12, handles 14, 16 and cover 26. A head, or knurled knob 52 is mounted on the lower end of post 44 as shown.

Figure 3:
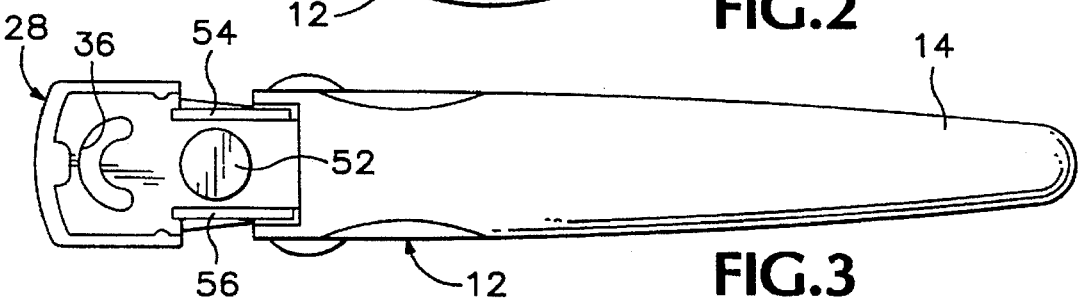
FIG. 3 is a bottom view of the clipper of FIG. 2.

Nose piece 50 includes a pair of downwardly extending side flanges 54, 56, in FIGS. 3 and 8, which extend over the edges of nail holder 28 and blade 38. A pair of opposed shoulders 55, 57 (FIG. 8) formed opposite one another on the inner surfaces of flanges 54, 56, respectively, support nose piece 50 on nail hold 28 when shoulder 49 is firmly abutted against nose piece 50 as shown in FIGS. 6 and 7. This creates an opening beneath nose piece 50 in which blade 38 can slide between the positions of FIGS. 6 and 7.

A shoulder or first surface 58 is formed on handle 16 and abuts an opposing shoulder or second surface 60 on nose piece 50 when the handles are in their normally open position as shown in FIG. 6. A portion 59 of body 12 is viewable in FIGS. 1 and 7. Surfaces 58, 60 pivot away from one another when the handles are squeezed together as shown in FIG. 7. Travel of blade 38 is limited in one direction when one end of slot 42 abuts post 44, as shown in FIG. 6, and in the other direction when the other end of slot 42 abuts post 44, as shown in FIG. 7. This has a corresponding limiting effect on the pivoting range of handle 16 about fastener 18.

Blade 38 includes a pair of lateral slots 62, 64. In the view of FIG. 6, a tooth 66 formed on handle 16 extends into slot 62 and a tooth 68, also formed on the handle, extends partially into slot 64. A tooth 69 abuts against one end of blade 38 in the configuration of FIG. 7. Teeth 66, 68, 69 each comprise what might be thought of as adjacent gear teeth. When handle rotates downwardly, in the view of FIG. 6, teeth 66, 68, 69 urge blade 38 to the left as shown in FIG. 7. Such action translates rotational handle movement to lateral blade movement in a rack-and-pinion fashion.

Figure 4:
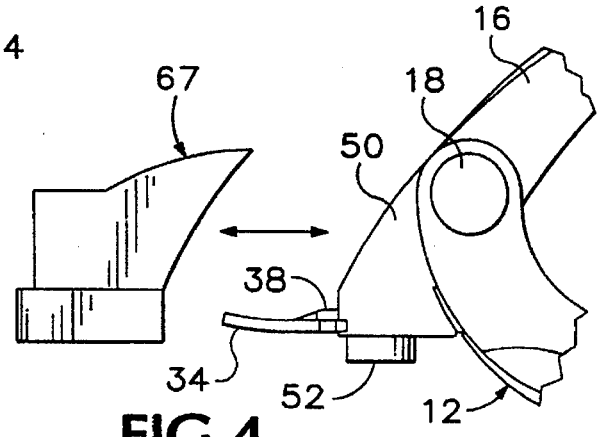
FIG. 4 is a partial side elevation view similar to FIG. 2 with the nail catcher disconnected from the clipper.

A nail catcher 67 includes an interior groove 70, in FIGS. 6 and 7, which fits around the perimeter of nail holder 28 when the nail catcher slides onto the nail holder as depicted in FIG. 4. The nail catcher includes an interior surface 72 above aperture 36. As will be described in more detail hereinafter, nail ends cut from acrylic nails installed on a user's fingernails are received in and contained by nail catcher 67.

Consideration will now be given to the manner in which the nail clipper of the present invention is used. In the usual case, acrylic artificial nails are applied in a known manner to a wearer's natural fingernails. The nails in cross section includes a curve similar to the curve of the a natural fingernail. The acrylic nails, typically fairly long, must be trimmed. After the acrylic nails are applied, one nail is inserted into opening 36 in nail holder 28 with the cross-sectional arc of the nail being oriented in the same manner as the arc of opening 36.

The tip of the acrylic nail may be urged against surface 72 thereby defining a predetermined nail length when the nail is cut. It should be appreciated that different sizes of nail catcher 67 can be provided to generate nails of different lengths. Alternatively, interior lips having different distances from opening 36 may be formed in the nail catcher to provide a plurality of different surfaces against which the nail tip can be urged and therefore provide different predetermined lengths to which a nail may be cut.

When the nail is so positioned, a user, typically a beautician, squeezes handles 14, 16 together. This causes pivoting of handle 16 about the axis of rivet shaft 19 and also compresses spring 20 together to the position shown in FIG. 7. Such pivoting causes teeth 66, 68 to engage slots 62, 64, and tooth 69 abut against the end of the blade, and slide blade 38 across opening 36 from the position shown in FIG. 6 to that of FIG. 7 thereby cutting the nail.

After the nails are cut, the nail catcher 67 is slided off of nail holder 28 as depicted in FIG. 4 and the nail tips contained therein are thrown away.

After many cuttings, it may become necessary to remove blade 38 and install a new, sharp blade in its place. To do so, the nail catcher 67 is removed as described above. Thereafter, a user unscrews threaded shaft 48 by grasping knurled knob 52 and twisting it in a counterclockwise (when looking at head 52) direction. Thereafter the handles are squeezed slightly together, thereby causing surfaces 58, 60 to separate from one another by rotating from the position shown in FIG. 6 to that shown in FIG. 7. This permits removal of the nose piece 50 and post 44. At this point the handles can be squeezed even further together than the position shown in FIG. 7. When the handles are so squeezed, teeth 66, 68, 69 continue further counterclockwise rotation, as viewed in FIGS. 6 and 7, thereby continuing to drive blade 38 further leftwardly from the position shown in FIG. 7. As will be recalled, this is possible because post 44 is removed from slot 42. As soon as both of teeth 66, 68 are clear of slots 62, 64, respectively, the user can draw blade 38 to the left out from beneath the teeth, and insert a new blade. Before the handle is released, the blade is positioned to permit teeth 66, 68 to be received in the slots 62, 64 of the new blade, thereby drawing the same into the configuration of FIG. 7 at which point post 44 is reinserted to the position shown in FIG. 7. Threaded shaft 48 is then screwed into insert 51 to secure the nose piece 50, also shown in FIG. 7. When handles 14,16 are released, spring 20 biases the handles back into the position of FIG. 6 until one end of slot 42 abuts against post 44 as shown in FIG. 6, thereby preventing further handle opening and the clipper is in the configuration of FIG. 6. The nail catcher 67, if desired, is reinstalled and the clipper is again ready for use.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A clipper for trimming a finger nail comprising:

a clipper body including a first handle;

a second handle opposing the first handle and pivotally coupled to said clipper body;

a substantially planar nail holder having a proximal end attached to the clipper body and a distal end, the holder having a crescent shaped aperture with a bight portion thereof extending toward the distal end for receiving the finger nail;

a substantially planar blade having a blade edge, said blade being in slidable face-to-face relation with a side of said nail holder;

a first slot formed in said blade;

a post mounted on said nail holder and extending through said slot;

a second slot formed in said blade; and a tooth mounted on said second handle and extending into said second slot, said tooth sliding the blade responsive to pivoting of said second handle.

2. The clipper of claim 1 wherein said clipper includes a head on one end of said post and a threaded shaft on the other end thereof.

3. The clipper of claim 2 wherein said clipper further includes a threaded element engaged on said threaded shaft when said clipper is in operative condition.

4. The clipper of claim 3 wherein said clipper further includes a shoulder formed at the juncture of said post and said threaded shaft, said shaft being screwed into said element until said shoulder abuts said element.

5. The clipper of claim 1 wherein said blade is slidable along a substantially single axis and wherein said blade edge forms an acute angle relative to said axis.

6. The clipper of claim 1 wherein said clipper body and said second handle are molded from a polymer.

7. The clipper of claim 1 wherein said clipper further includes a nail catcher operatively connected to said nail holder for catching and holding cut nails.

8. The clipper of claim 1 wherein said clipper further includes a torsion spring for biasing said blade into a position in which it does not cover said aperture.

9. The clipper of claim 1 wherein said clipper further includes a gauge for measuring the length of nail cut prior to cutting.

10. A clipper for trimming a finger nail comprising:

a substantially planar nail holder having an aperture for receiving the finger nail;

a substantially planar blade having a blade edge, said blade being in slidable face-to-face relation with one side of said nail holder substantially along a first axis;

an elongate slot formed in said blade along a second axis which is substantially parallel with said first axis;

a post extending through said slot;

a head formed on one end of said post adjacent one side of said nail holder;

a threaded shaft formed on the other end of said post;

an element threadably engaged on said threaded shaft when said clipper is in operative condition; and a shoulder formed at the juncture of said post and said threaded shaft, said shaft being screwed into said element until said shoulder abuts said element.

11. The clipper of claim 10 wherein said clipper further comprises a clipper body having a first handle, said nail holder being mounted on said clipper body, and wherein said clipper further comprises a second handle opposing the first handle and pivotally coupled to said clipper body.

12. The clipper of claim 11 wherein said clipper further includes a tooth operatively disposed between said second handle and said blade for sliding the blade responsive to pivoting said second handle.

13. The clipper of claim 12 wherein said blade further includes a second slot formed therein and wherein said tooth is rigidly mounted on said second handle and has an end received in said second slot.

14. The clipper of claim 11 wherein said body and second handle are molded from polymer, said element is received in a molded polymer piece having a first surface formed thereon and said second handle has a second surface formed thereon, said first and second surfaces abutting one another when said first and second handles are fully opened.

15. The clipper of claim 10 wherein said head comprises a knurled knob.

16. The clipper of claim 10 wherein said blade edge is formed at an acute angle relative to said second axis.

17. The clipper of claim 10 wherein said clipper further includes a gauge for measuring the length of nail cut prior to cutting.

18. A clipper for trimming a finger nail comprising:

a clipper body including a first handle;

a second handle opposing the first handle and pivotally coupled to said clipper body;

a substantially planar nail holder mounted on said body and having an aperture for receiving a finger nail therethrough;

a substantially planar blade having a blade edge and being slidable over the aperture for cutting a finger nail received therethrough; and a nail catcher operatively connected to said nail holder for catching a finger nail cut when said blade slides over the aperture when a finger nail is received therethrough.

19. The clipper of claim 18 wherein said catcher includes an interior surface for urging a finger nail thereagainst for cutting the nail to a predetermined length.

* * * * *